US005299619A

United States Patent [19]

Chandley et al.

[11] Patent Number: 5,299,619

[45] Date of Patent: Apr. 5, 1994

[54] METHOD AND APPARATUS FOR MAKING INTERMETALLIC CASTINGS

[75] Inventors: George D. Chandley, Amherst, N.H.; Merton C. Flemings, Cambridge, Mass.

[73] Assignee: Hitchiner Manufacturing Co., Inc., Milford, N.H.

[21] Appl. No.: 997,726

[22] Filed: Dec. 30, 1992

[51] Int. Cl.[5] ..... B22D 18/06; B22D 23/00; B22D 27/04

[52] U.S. Cl. ..... 164/53; 164/61; 164/63; 164/66.1; 164/133; 164/337; 164/493

[58] Field of Search ..... 164/133, 335, 337, 53, 164/493, 513, 338.1, 61, 66.1, 258, 63

[56] References Cited

U.S. PATENT DOCUMENTS

| | | | |
|---|---|---|---|
| 2,564,337 | 8/1951 | Maddex . | |
| 2,581,253 | 1/1952 | Ellis et al. . | |
| 2,871,533 | 2/1959 | Swainson | 164/337 |
| 3,435,878 | 4/1969 | Howard et al. . | |
| 3,484,840 | 12/1969 | Spoth et al. . | |
| 3,598,168 | 8/1971 | Clark . | |
| 3,752,221 | 8/1973 | Copley et al. . | |
| 3,775,091 | 11/1973 | Clites et al. . | |
| 4,580,617 | 4/1986 | Blechner et al. . | |
| 4,738,713 | 4/1988 | Stickle et al. . | |
| 4,740,246 | 4/1988 | Feagin . | |
| 5,042,561 | 8/1991 | Chandley . | |
| 5,093,148 | 3/1992 | Christodoulou et al. . | |

FOREIGN PATENT DOCUMENTS

| | | | |
|---|---|---|---|
| 0387107 | 9/1990 | European Pat. Off. . | |
| 1515933 | 6/1978 | United Kingdom . | |
| 2092037 | 8/1982 | United Kingdom | 164/335 |

*Primary Examiner*—Kuang Y. Lin

*Attorney, Agent, or Firm*—Flynn, Thiel, Boutell & Tanis

[57] ABSTRACT

The present invention involves a method and apparatus for making an intermetallic casting (e.g. a titanium, nickel, iron, etc. aluminide casting) wherein a charge of a solid first metal protected from air as required is disposed in a vessel, and a charge of a second metal that reacts exothermically with the first metal is melted in another vessel. The molten second metal is introduced to the vessel containing the charge of the first metal so as to contact the first metal. The first and second metals are heated in the vessel to exothermically react them and form a melt for gravity or countergravity casting into a mold. The exothermic reaction between the first and second metals releases substantial heat that reduces the time needed to obtain a melt ready for casting into a mold. In particular, the exothermic reaction between the first and second metals, in effect, reduces the residence time of the intermetallic melt in the vessel. This reduced residence time, in turn, reduces potential contamination of the melt by reaction with the vessel material. Moreover, the energy requirements needed to heat and melt the metals in the vessel are considerably reduced. Low cost forms of the first and second metals can be used in practicing the invention. As a result, overall casting costs are reduced. The method and apparatus of the invention can be used to produce large numbers of low cost, low contamination intermetallic castings as needed by the automobile, aerospace, and other industries.

21 Claims, 5 Drawing Sheets

METHOD AND APPARATUS FOR MAKING INTERMETALLIC CASTINGS

FIELD OF THE INVENTION

The present invention relates to method and apparatus for producing intermetallic castings, such as, for example, titanium aluminide castings, in high volumes at reduced cost without harmful contamination resulting from reactions between the intermetallic melt and melt containment materials.

BACKGROUND OF THE INVENTION

Many alloys with high weight percentages of a reactive metal, such as titanium, react with air and most common crucible refractories to the degree that the alloy is contaminated to an unacceptable extent. As a result, it is common to melt such alloys in water cooled, metal (e.g. copper) crucibles using electric arc or induction to generate heat in the alloy charge.

U.S. Pat. No. 4 738 713 is representative of one such melting technique. The patented melting method is very inefficient in the use of electrical power. Moreover, experience with such a method indicates that the amount of melt superheat achievable is limited and sensitive to crucible life. However, the method is in use since the method can use lower cost melt stock than consumable arc melting techniques which require specially prepared melting electrodes of the alloy desired.

Arc melting techniques using water cooled copper crucibles (e.g. see U.S. Pat. No. 2 564 337) can provide higher superheats in melting the reactive alloys. However, arc melting techniques, as well as induction melting techniques, are dangerous due to the potential for explosion in the event of crucible failure wherein cooling water comes into contact with the molten reactive alloy to form hydrogen gas. Both arc melting and induction melting techniques are practiced in remote manner, such as from behind explosion proof walls in specially constructed buildings with blow-out walls. As a result, operation of such cold-wall metal crucibles or furnaces has been costly with good process control difficult to achieve.

Some prior art workers have melted and cast reactive alloys, such as titanium alloys, using calcium oxide crucibles. However, contamination of the alloy melt with oxygen is rapid and, with some alloys containing aluminum, extensive aluminum oxide vapor is evolved in such amounts as to preclude practical operation of traditional casting units by contaminating vacuum systems and chambers associated with the casting unit.

Other prior art workers, see U.S. Pat. No. 3 484 840, have rapidly melted titanium alloys in graphite lined crucibles in order to avoid harmful contamination of the melt. The patented process does not permit accurate control of the melt temperature and excessive melt contamination can occur if the heating cycle is too long. In addition, control of the melt flow out of the bottom of the crucible is difficult since melting of the center portion of a metal disc at the crucible bottom is employed to this end. With this arrangement, the melt flow orifice will vary with the melting rate, charge diameter, and disc size, making control of melt flow difficult.

Intermetallic alloys, such as especially TiAl, have received considerable attention in recent years for use in the aerospace and automobile industries in service applications where their high strength at elevated temperature and relatively light weight are highly desirable. However, these intermetallic alloys contain a majority of titanium (e.g. so-called gamma TiAl includes 66 weight % Ti with the balance essentially Al) which makes melting and casting without contamination difficult and very costly. In order to be adapted for use in such components as automobile exhaust valves, the intermetallic alloys must be melted and cast without harmful contamination in a high production, low cost manner.

It is an object of the present invention to provide a method and apparatus useful for, although not limited to, making intermetallic castings without harmful contamination in a high production, low cost manner especially suited to the requirements of the automobile, aerospace and other industries.

It is another object of the present invention to provide a method and apparatus for making intermetallic castings using a refractory melting vessel and a combination of molten and solid melting stock in a manner to avoid harmful contamination of the melt by reaction with the vessel.

It is another object of the invention to provide a method and apparatus for making intermetallic castings in a low cost manner by virtue of using relatively low cost melting stock which requires reduced energy requirement in order to yield a melt ready for casting into a mold.

SUMMARY OF THE INVENTION

The present invention involves a method and apparatus for making an intermetallic casting (e.g. a titanium, nickel, iron, etc. aluminide casting) wherein a charge comprising a solid first metal is disposed in a vessel, and a charge comprising a second metal that reacts exothermically with the first metal is melted in another vessel. The molten charge comprising the second metal is introduced to the vessel containing the charge of the first metal so as to contact the first metal. Alternately, a charge of the second metal in solid form is placed in the melting vessel to contact the other charge. The charges comprising the first and second metals are rapidly heated (e.g. by induction) in the vessel to exothermically react them and form a melt heated to a castable temperature for gravity or counter-gravity casting (e.g. as shown in U.S. Pat. No. 5 042 561) into a mold. The exothermic reaction between the first and second metals releases substantial heat (i.e. the intermetallic has a high heat of formation) that reduces the time needed to obtain a melt ready for casting into a mold. In particular, the exothermic reaction between the first and second metals, in effect, reduces the residence time of the intermetallic melt in the vessel. This reduced residence time, in turn, reduces potential contamination of the melt by reaction with the vessel material. Means, such as a vacuum, inert gas or substantially non-reactive atmosphere, preferably is used during the method as required to preclude the melt and casting from harmful reaction with air.

Moreover, the energy requirements needed to heat and melt the metals in the vessel are considerably reduced. Low cost forms of the first and second metals can be used in practicing the invention. As a result, overall casting costs are reduced. The method and apparatus of the invention can be used to produce large numbers of low cost, contamination-free intermetallic castings as needed by the automobile, aerospace, and other industries.

In one embodiment of the invention, the charge of the first metal is selected from one of titanium, nickel, iron, or other desired metal. The molten or solid charge of the second metal is aluminum, silicon, or other desired metal. The charge of the first metal preferably is preheated prior to introduction of the molten second metal in the vessel.

In another embodiment of the invention, the melt is gravity cast into a mold disposed below the vessel by breaking or fracturing a frangible closure member at a bottom of the vessel so as to communicate the mold and the vessel. The melt temperature (e.g. melt superheat) can be accurately controlled by appropriate timing of the breakage of the closure member to release the melt into the underlying mold. The closure member can be broken by striking it with a movable tapping rod in the vessel or, alternately, by establishing a suitable fluid pressure differential across the closure member, such as by raising the gas pressure on the melt inside the vessel relative to gas pressure outside the vessel.

In still another embodiment of the invention, the melt is countergravity cast into a mold disposed above the vessel through a fill pipe located between the melt and the mold (e.g. see U.S. Pat. No. 5 042 561). After countergravity casting, the vessel can be drained of unused melt remaining therein by breaking a frangible closure member at a bottom of the vessel. Upon breakage of the closure member, the vessel is communicated to an underlying chill mold for receiving and solidifying the unused melt in the chill mold. This arrangement reduces the time required to remove unused, drained melt and assemble a new crucible and mold for further casting.

In still another embodiment of the invention, the mold comprises a thin-walled investment mold disposed in a mass of refractory (e.g. ceramic) particulates during gravity or countergravity casting of the melt therein. The melting vessel may be also surrounded by a mass of similar refractory particulates. The particulate masses (or other non-reactive confining means) confine any melt that might escape from the vessel or mold.

In a particular embodiment of the invention, a plurality of titanium aluminide castings are made by disposing a charge of solid titanium in a refractory (e.g. graphite) lined vessel, preheating the charge to an elevated temperature below the liquidus temperature of titanium, melting aluminum in another vessel, and introducing the molten aluminum to the lined vessel so as to contact the charge of titanium. The aluminum and titanium are heated in the vessel to exothermically react and form an intermetallic melt for gravity or countergavity casting into an investment mold having a plurality of molding cavities. The exothermic reaction between the aluminum and titanium reduces the residence time of the melt in the vessel to reduce contamination of the melt by reaction with the vessel and also reduces energy requirements for producing the melt ready for casting. The titanium metal and aluminum can comprise relatively low cost scrap metal.

Other objects and advantages of the present invention will become apparent from the following detailed description and the drawings.

DESCRIPTION OF THE DRAWINGS

In FIG. 2, like features of FIG. 1 are represented by like reference numerals.

DETAILED DESCRIPTION OF THE INVENTION

Figure 1:
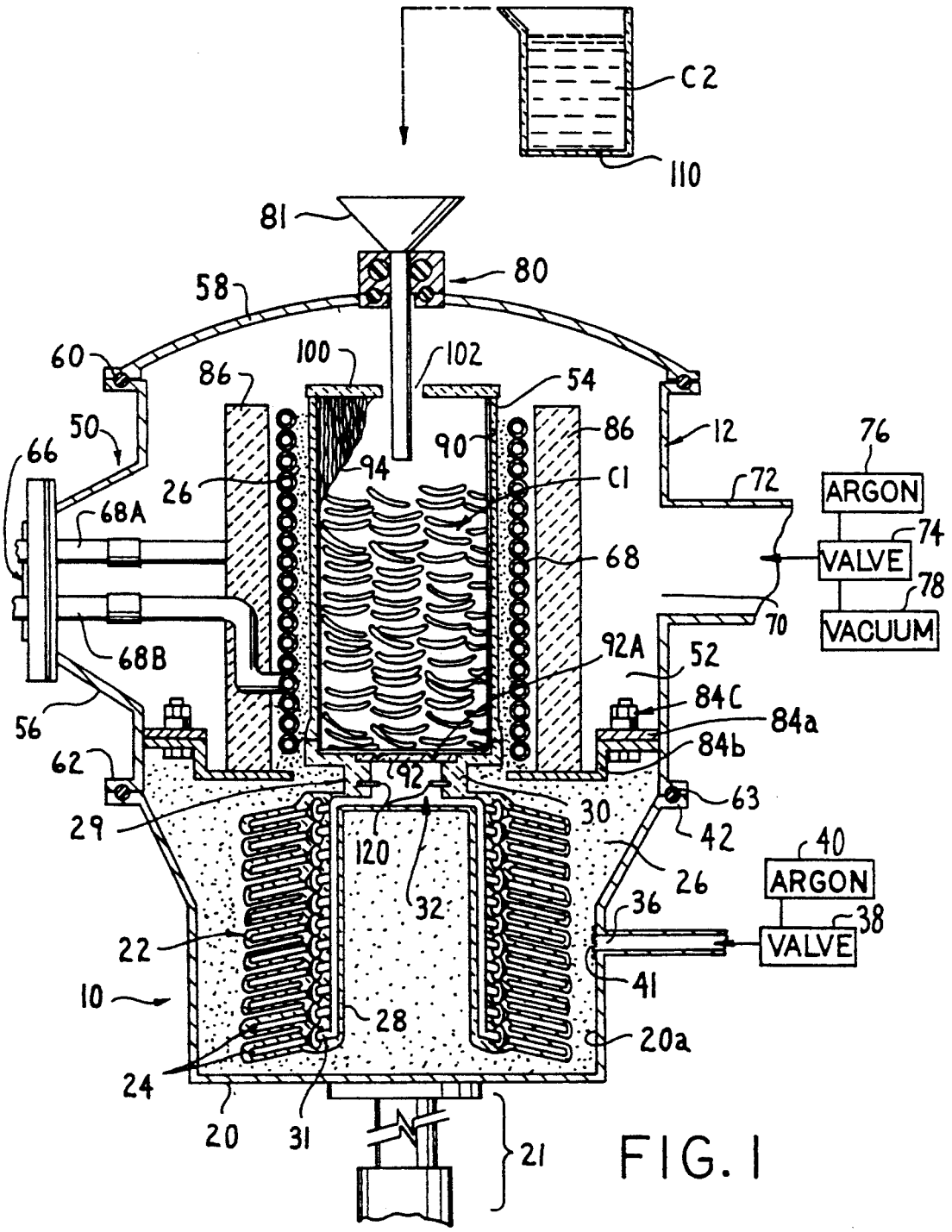
FIG. 1 is a schematic, sectioned side view of an apparatus in accordance with one embodiment of the invention for practicing a gravity casting method embodiment of the invention.

Referring to FIG. 1, apparatus in accordance with an embodiment of the invention for making intermetallic castings is shown as including a mold section 10 and a stationary melting section 12 with the mold section disposed beneath the melting section for gravity casting of an intermetallic melt. Although the apparatus will be described with respect to casting a TiAl melt for purposes of illustration, the invention is not so limited and can be practiced to make castings of other intermetallic alloys such as including, but not limited to, $Ti_3Al$, $TiAl_3$, NiAl, and other desired aluminides and silicides wherein the intermetallic alloy comprises first and second metals that react exothermically in the manner described herebelow. The intermetallic alloy can include alloyants in addition to the first and second metals. For example, a TiAl alloyed with Mn, Nb, and/or other alloyant can be cast.

The mold section 10 includes a steel mold container 20 having a chamber **20*a* in which an investment mold 22 having a plurality of mold cavities 24 is disposed in a mass 26 of low reactivity particulates. The chamber 20 includes a lower cylindrical region and an upper conical region as shown. The mold 22 includes a down feed or sprue 28 connected to the mold cavities 24 via lateral ingates 31**.

An upper extension or region 29 is formed integrally with the mold 22 to provide a cylindrical, melting vessel support collar 30 and a central, cylindrical melt-receiving chamber 32 that communicates the mold sprue 28 to the melting vessel 54.

The investment mold 22 and the integral extension 29 are formed by the well known lost wax process wherein a wax or other removable pattern is invested with refractory particulate slurry and stucco in repeated fashion to build up a desired mold wall thickness about the pattern. The pattern is then removed by melting or other techniques to leave the mold which is typically fired thereafter at elevated temperature to develop desired strength for casting.

For casting the TiAl intermetallic alloy mentioned hereabove, the investment mold 22 includes an inner zirconia or yttria facecoat and zironia or alumina outer back-up layers forming the body of the mold (e.g. see U.S. Pat. No. 4 740 246). The total mold wall thickness employed can be from 0.1 to 0.3 inch. The inner face coat is selected to exhibit, at most, only minor reaction with the TiAl melt cast therein so as to minimize contamination of the melt during solidification in the mold 22. A preferred inner mold-facecoat for casting TiAl is applied as a slurry comprising zirconium acetate liquid and zirconia flour, dried, and stuccoed with fused alumina (mesh size 80). One facecoat layer is applied. Preferred backup layers for use with this facecoat are applied as a slurry comprising ethyl silicate liquid and tabular alumina, dried, and stuccoed with fused alumina (mesh size 36). Suitable mold face coats for melts other than TiAl can be readily determined.

The particulates of mass 26 are selected to exhibit low reactivity relative to the particular melt being melted and cast into the mold 22 so that in the event of any melt leakage from the mold 22, the melt will be confined in a harmless manner without reaction in the mass 26. For a TiAl melt, the particulates of mass 26 comprise zirconia grain of −100 +200 mesh size.

The mold container 20 includes a port 36 communicated via a conventional on/off valve 38 to a source 40 of argon or other inert gas. The port 36 is screened by a perforated screen 41 selected to be impermeable to the particulates of mass 26 so as to confine them within the container 20. As will be described herebelow, the valve 38 is actuated during the casting operation to admit argon gas to the container 20 about the mold.

The mold container 20 is movable relative to the melting section 12 by an elevator 21 (shown schematically) beneath the container 20. The mold container 20 includes proximate its upper end a radially extending, peripheral shoulder or flange 42 which is adapted to engage the melting section 12 during the casting operation.

In particular, the melting section 12 includes a metal (e.g. steel) melting enclosure 50 forming a melting chamber 52 about a refractory melting vessel 54. The melting enclosure 50 includes a side wall 56 and a removable top 58 sealed to the side wall via a sealing gasket 60.

The side wall 56 includes a radially extending, peripheral shoulder or flange 62 against which the mold container shoulder or flange 42 is sealingly engaged by actuation of the lift 21 during the casting operation. A gas sealing gasket 63 is disposed between the shoulders 42, 62.

The side wall 56 also includes a sealed entry port 66 for passage of electrical power supply couplings 68*a*, 68*b* from an electrical power source (not shown) to an induction coil 68 disposed in the chamber 52 about the melting vessel 54. The side wall 56 also includes a port 70 communicated via a conduit 72 and valve 74 to a source 76 of argon or other inert gas and, alternately, to a vacuum source (e.g. vacuum pump) 78.

Figure 2:
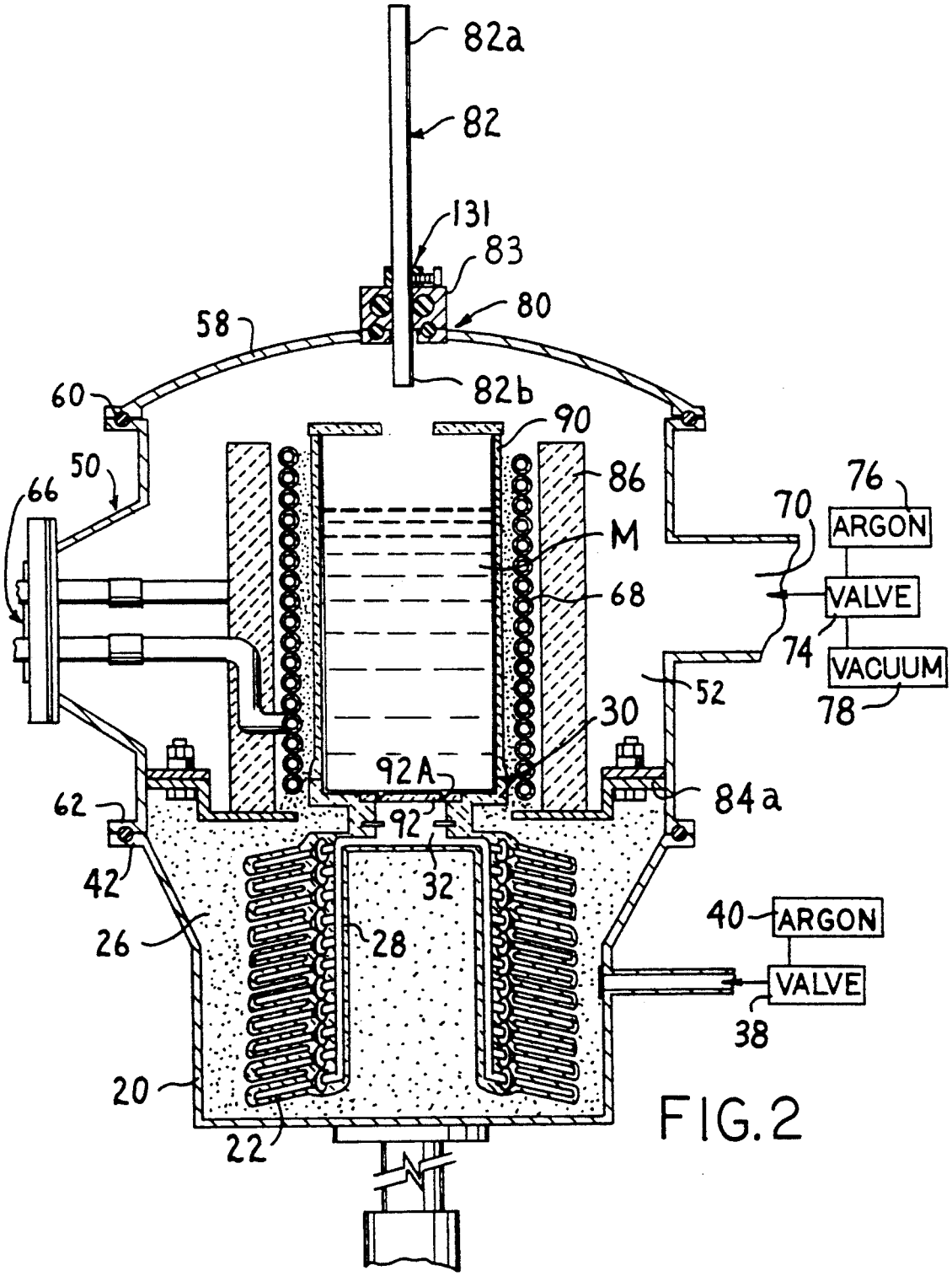
FIG. 2 is similar to FIG. 1 with the funnel replaced by the tapping rod.

The removable top 58 includes a sealable port 80 through which a molten metal component of the intermetallic melt is introduced into the melting vessel 54 via a refractory (e.g. clay bonded mullite) funnel 81 temporarily inserted in port 80. An optional tapping rod 82 can also be sealingly received in the port 80 as shown in FIG. 2 for use in a manner to be described to release melt from the melting vessel 54.

The side wall 56 includes an outer, annular shoulder or flange 84*a* fastened to an inner, annular shoulder 84*b* on which coil supports 86, typically 4, are circumferentially disposed to support the induction coil 68. The flanges 84*a*, 84*b* are fastened by nut/bolt fasteners 84*c* so as to permit different flanges 84*b* to be used to accommodate different size melting vessels/induction coils.

The mass 26 of particulates extends upwardly between the coil 68 and the melting vessel 54 so as to confine any melt that might leak or otherwise escape from the vessel 54 within the low reactivity particulates.

As shown in FIG. 1, a cylindrical, tubular ceramic shell 90 is supported and fastened (e.g. by potassium silicate ceramic adhesive) atop the collar 30. The collar 30 is shown including a frangible, refractory closure member 92 held in position by gravity so as to be located proximate the bottom of the melting vessel 54. The closure member 92 includes annular notch 92*a* that renders the closure member readily breakable to release the melt from the melting vessel 54 to the mold 22.

The ceramic shell 90 is also formed by the lost wax process described hereabove from like ceramic materials to like wall thickness as used for the mold 22. The closure member 92 is also of like material and thickness as the mold 22 and shell 90.

The melting vessel 54 thus is formed by the collar 30, shell 90, and closure member 92. After the collar 30, shell 90, and closure member 92 are assembled together to form the melting vessel 54, the vessel 54 is lined with GRAFOIL graphite sheet or graphite cloth material liner 94 available from Polycarbon Corporation. The liner thickness is typically 0.010 inch. The liner 94 is adequately non-reactive with the melt over the short time period that the melt resides in the melting vessel 54. The liner may be coated with yttria to reduce carbon pickup by the melt. Other liner materials that can be used for containing the TiAl melt include, but are not limited to, yttria and thoria. Liner materials suitable for melts other th-an TrAl melt can be selected as desired so as to be generally non-reactive with the melt during the melt residence time in the vessel 54.

The open upper end of the melting vessel 54 is partially closed by a closure plate 100 made of fibrous alumina. The plate 100 includes a central opening 102 through which the molten metal component of the intermetallic melt can be introduced to the vessel. The opening also receives the aforementioned tapping rod 82, if used.

In use in accordance with a method embodiment of the invention, the mold 22 is invested in the particulate mass 26 (e.g. zirconia grain) in the container 20. The GRAFOIL lined shell 90 with the closure member 92 thereon then is placed against the collar 30.

A charge C1 of solid unalloyed titanium (first metal of the intermetallic alloy) pieces is positioned in the melting vessel 54 and the plate 100 is placed on the shell 90. The charge C1 of titanium can comprise titanium scrap sheet, briquettes, or other shapes. Alloyant(s) to be included in the melt may be dispersed as alloyant particulates with the titanium charge C1 so as to provide fast solutioning of the alloyant in the melt.

The Ti scrap sheet pieces are typically 1 inch×1 inch×1/16 inch maximum in size and obtained from Chemalloy Co. The briquettes are made from titanium sponge to sizes approximately 1 inch×1 inch×3 inches. The titanium charge C1 is added in an amount to provide the desired Ti weight % in the intermetallic casting. The charge C1 typically is introduced manually.

The charged assembly is raised upward by the elevator 21, such as a hydraulic lifting mechanism, located beneath the container 20. The charged assembly is raised to position the melting vessel 54 within the induction coil 68 in the stationary melting enclosure 50. The top 58 of the melting enclosure 50 is absent or remotely positioned at this point.

The annular space between the melting vessel 54 and the coil 68 then is filled through the open enclosure 50 with the particulates (zirconia grain) to extend the mass 26 to the level shown in FIG. 1 about the vessel 54. The top 58 then is sealingly positioned on the sealing gasket 60 of side wall 56 in preparation for initiation of the melting/casting operation.

At the beginning of the casting cycle, the melting chamber 52 is first evacuated to less than 0.1 torr (100 microns) and then backfilled with argon to slightly above atmospheric pressure (>5 torr, usually 5–80 torr) via the port 70. The charge (melting stock) C1 of induction coil 68 to 300–1500° F. (i.e. below the liquidus temperature of titanium).

Concurrently, a charge (melting stock) C2 of aluminum is melted in a melting vessel 110 outside the casting apparatus to provide the second metal component of the intermetallic alloy. In particular, a charge of aluminum scrap or other unalloyed (or alloyed with a small % of alloyant) aluminum is air melted by a conventional gas-fired melter in the vessel 110 which is composed of a clay/graphite refractory. The molten aluminum charge C2 is heated in vessel 110 to about 1300° F., providing 80° F. of superheat. The molten aluminum is poured into the melting vessel 54 through the refractory funnel 81 temporarily positioned in the port 80 which is open to this end. The amount of molten aluminum added to the vessel 54 corresponds to the weight % of aluminum desired in the intermetallic alloy. The funnel is removed, and the tapping rod 82 then is sealingly inserted in the port 80 and held in a position above and aligned with the vessel plate opening 102. The funnel 81 is removed, and the tapping rod 82 is then sealingly disposed in the port 80 as shown in FIG. 2.

The melting chamber 52 is then evacuated to about 100 microns or less via the port 70. Evacuation of the chamber 52 also results in evacuation of the mold container 20 and its contents to the same level. The tapping rod 82 is retained or held in the position of FIG. 2 by a wing bolt clamp 131 engaged about the rod 82 and engaging the top seal member 83 of the top 58

Upon reaching the desired vacuum level in the chamber 52 (e.g. 60 seconds), the induction coil 68 is energized to a power level to heat/melt the solid titanium charge C1 and the molten aluminum charge C2 and react them in the melting vessel 54. The titanium and aluminum charges react exothermically in the vessel 54 to generate substantial heat that accelerates the melting process to reduce the time needed to obtain an intermetallic melt M ready for casting into the mold 22 and that also replaces electrical power that otherwise would be required from the induction coil 68. Generally, a power level in the range of 200 to 240KW applied for 1.25 to 2.00 minutes can be used to produce TiAl melts in the range of 40 to 50 pounds. The power level and time can be varied and controlled to achieve the desired superheat in short times. Other power levels and times can be used produce melts of other intermetallic alloys.

The time required to produce a TiAl melt in the vessel 54 ready for casting in the mold 22 is quite short, not exceeding a power-on time of about 2 minutes typically. As a result, the residence time of the melt in the vessel 54 is short enough that no harmful reaction of the melt and the vessel refractory liner is experienced. This results in a melt that is useful for structural castings. Specifically, carbon contents less than 0.04 weight % and oxygen contents less than 0.18 weight % have been obtained in the melt.

As soon as the melt reaches the desired casting (superheat) temperature (e.g. after only 1.25 minutes), the melt is cast into the mold 22 by movement of the tapping rod 82 downwardly in a manner to strike and break the frangible closure member 92 and the liner 94. This releases the melt for gravity flow into the central chamber 32 and down the sprue 28 into the mold cavities 24 via the lateral ingates 31. Casting of the melt into the mold 22 is thus precisely controlled by controlling the time at which the closure member 92 is broken to release the melt for flow to the mold 22. The broken closure member 92 is caught by three (only two shown) circumferentially spaced zirconia rods 120 in the central chamber 32 so as to maintain melt flow passages open.

The tapping rod 82 is released by manually releasing the wing bolt clamp 131 to allow atmospheric pressure on the outer rod end 82*a* to move the rod 82 toward the vessel through the melt to allow the inner rod end 82*b* to break the closure member 92 and liner 94.

In lieu of using the tapping rod 82 to break the closure member 92, a pressure differential can be established across the closure member to this same end. For example, the interior of the melting vessel 54 can be pressurized via a suitable argon gas pressure supply conduit 121 and cap 122 (FIG. 3) positionable over the open upper end of the vessel 54 to introduce argon gas thereinto, for example, from a conventional argon source 129 via a valve 133. The interior of the vessel 54 thereby can be pressurized relative to the container 20 to establish a sufficient gas pressure differential across the closure member 92 to break it when the melt is at the desired casting temperature, thereby releasing the melt to flow from the vessel 54 to the mold 22.

Figure 3:
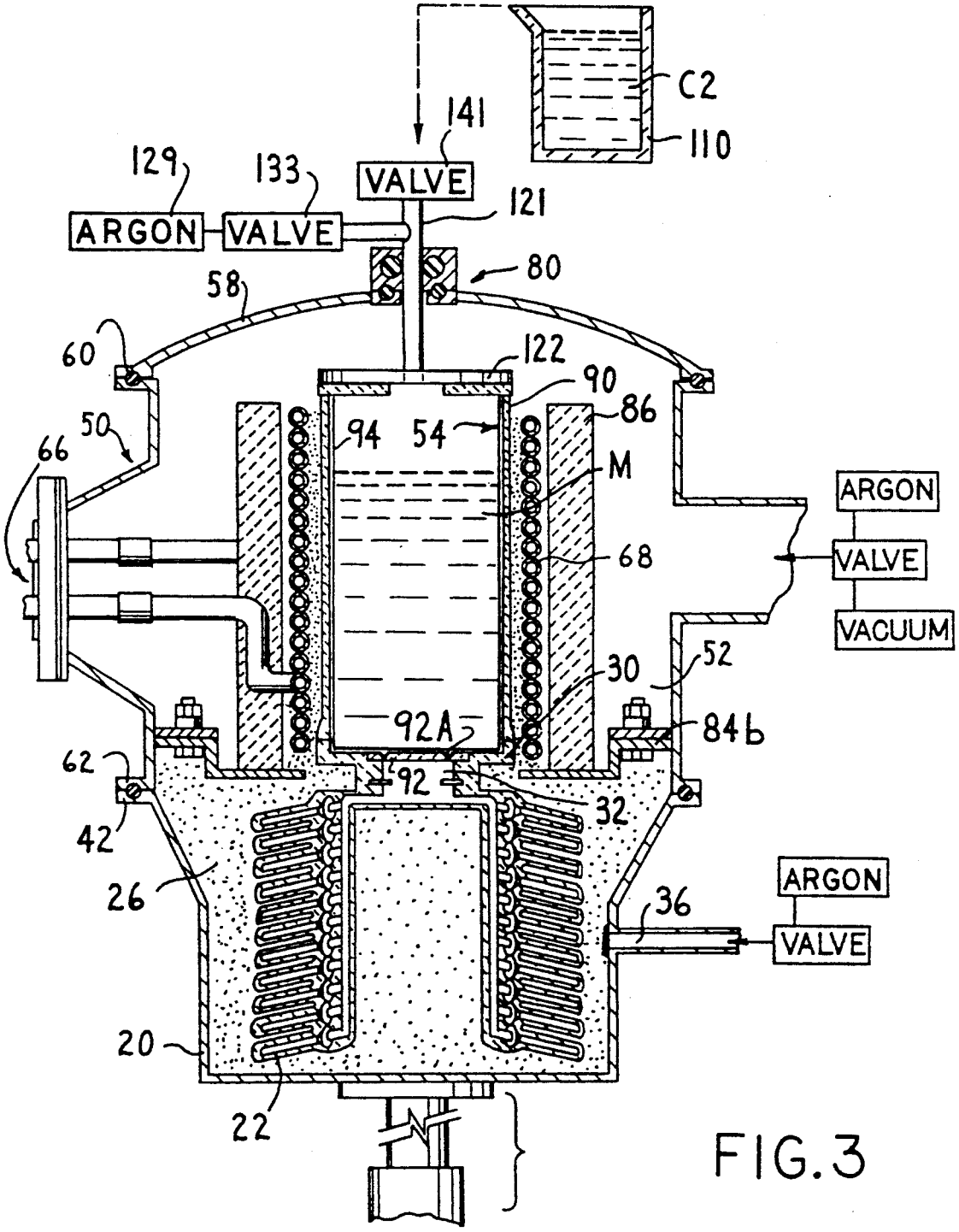
FIG. 3 is a view of apparatus similar to that of FIG. 1 illustrating an alternative means (gas pressure differential means) for breaking the bottom closure member of the melting vessel.

In FIG. 3, the Al melt is introduced from the vessel 110 through a valve 141 which is opened to this end. The melt is poured through a funnel (not shown) communicated to the open valve 141. The melt flows through conduit 121 into the vessel 54.

As mentioned hereabove, the mold material is selected to minimize melt/mold reactions while the melt solidifies in the mold 22. This also aids in production of TiAl castings free of harmful contamination.

After the melt is cast into the mold 22 in the manner described, the container 20 and chamber 52 are backfilled with argon to atmospheric pressure. In effect, the mold 22 containing the melt is flooded in an argon atmosphere while the melt cools and solidifies in the mold 22 to prevent oxidation of the casting. Once the container 20 and chamber 52 are filled with argon, the mold section 10 (flooded with argon through passage 36) can be removed from engagement with the melting section 12 by lowering the elevator 21. The container 20, melt-filled mold 22, and melting vessel 54 are thereby removed from the melting section 12 (i.e. from melting chamber 52) so that a new mold container 20, mold 22, and melting vessel 54 filled with a new titanium charge can be positioned in the melting chamber 52 as described hereabove to repeat the cycle described hereabove. Similarly, a new molten aluminum charge C2 is formed in the vessel 110.

Figure 4:
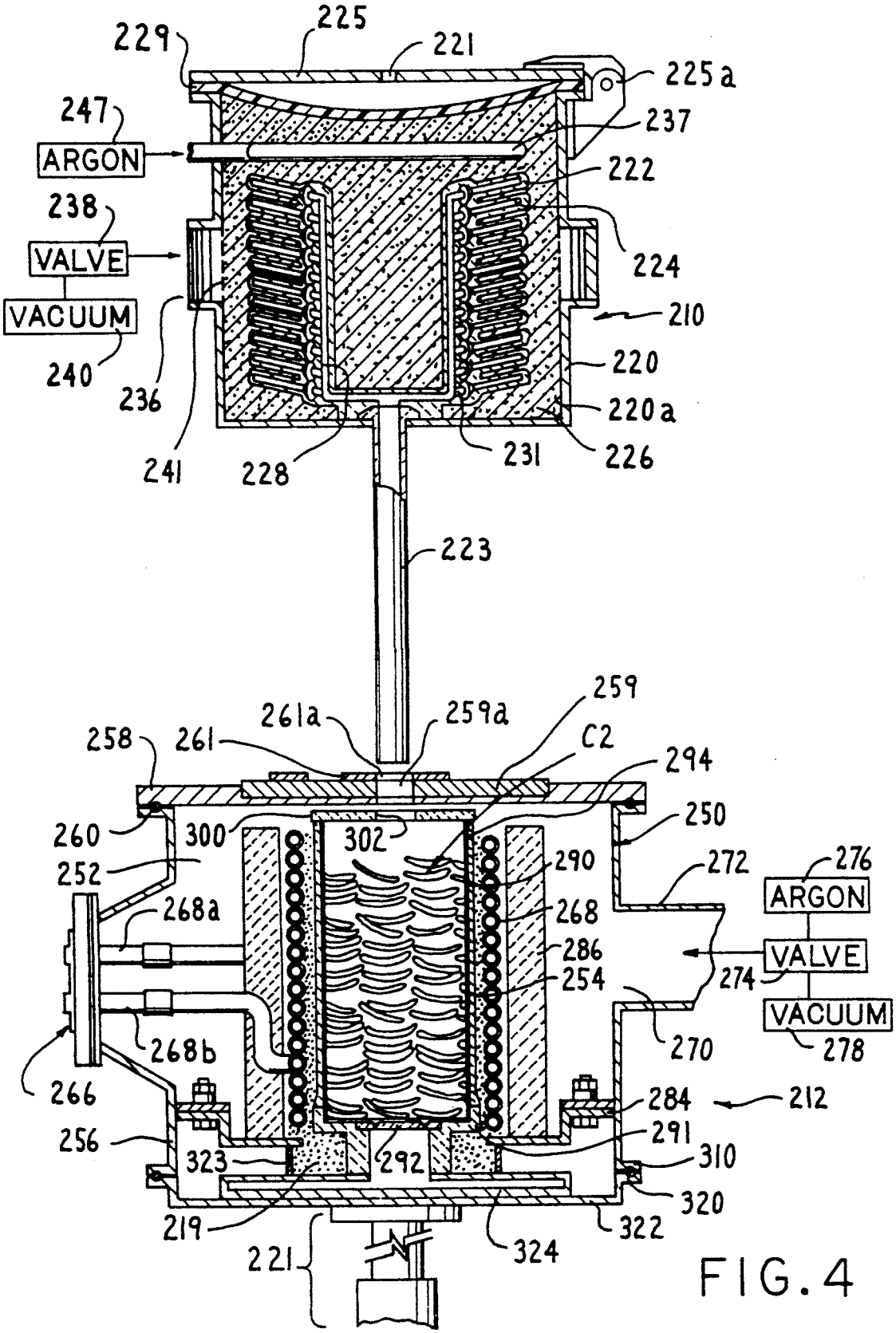
FIG. 4 is a schematic, sectioned side view of an apparatus in accordance with a second embodiment of the invention for practicing a countergravity casting method embodiment of the invention.

Referring to FIG. 4, apparatus in accordance with another embodiment of the invention for making intermetallic castings by countergravity casting is shown. In particular, the apparatus includes a mold section 210 and a melting section 212 with the mold section disposed above the melting section for countergravity casting the intermetallic melt. The mold container 220 is movable relative to the melting section 12 by a hydraulically actuated arm (not shown) as illustrated shown in aforementioned U.S. Pat. No. 5 042 561.

The mold section 210 includes a steel mold container 220 having a cylindrical chamber 220*a* in which an investment mold 222 having a plurality of mold cavities 224 is disposed in a mass 226 of low reactivity particulates. The mold 222 rests on an elongated, refractory (e.g. carbon) fill pipe 223 depending therefrom outside the container 220. The fill pipe 223 is joined to the bottom of the mold 222 and extends sealingly through a bottom opening in the container 220 as shown, for example, in U.S. Pat. No. 5 042 561. A mold sprue 228 is communicated to the fill pipe 223 and to the mold cavities 224 via lateral ingates 231. The investment mold 222 is formed by the aforementioned lost wax process.

The mold container 220 includes a openable/closeable lid 225 connected to the container via a hinge 225*a*. The lid 225 carries a sheet rubber gasket 229 communicated to ambient atmosphere by vent opening 221.

The mold 222 is embedded in particulates mass 226 selected to exhibit low reactivity to the particular melt being melted and cast into the mold 222 so that in the event of any melt leakage from the mold 222, the melt will be confined in a manner without harmful reaction in the mass 226. Suitable particulates for a TiAl melt are described hereabove. The rubber gasket 229 compacts the particulate mass 226 about the mold 222 when a relative vacuum is drawn in the container 220 to support the mold during casting.

The mold container 220 includes a peripherally extending chamber 236 communicated via a conventional on/off valve 238 to a source 240 of vacuum, such as a vacuum pump. The chamber 236 is screened by a perforated screen 241 selected to be impermeable to the particulates of mass 226 so as to confine them within the container 220. The mold container 220 also includes an inlet conduit 237 for admitting argon from a suitably screened distribution conduit 243 to the container 220 from a suitable source 247.

The melting section 212 includes a metal (e.g. steel) melting enclosure 250 forming a melting chamber 252 about a refractory melting vessel 254. The melting enclosure 250 includes a side wall 256 and a removable top 258 sealed to the side wall via a sealing gasket 260. A sliding cover 261 of the type set forth in aforementioned U.S. Pat. No. 5 042 561 is disposed on a fixed cover 259 of the top 258 and is slidable to receive fill pipe 223 for the purposes set forth in that patent. The fixed cover 259 includes an opening 259*a* for the mold fill pipe 223 as shown in FIG. 3. The sliding cover 261 includes an opening 261*a* for receiving the fill pipe 223 when openings 259*a*, 261*a* are aligned to cast the melt from the vessel 254 into the mold 222.

The side wall 256 includes a sealed entry port 266 for passage of electrical power supply couplings 268*a*, 268*b* from an electrical power source (not shown) to an induction coil 268 disposed in the chamber 252 about the melting vessel 254. The side wall 256 also includes a port 270 communicated via a conduit 272 and valve 274 to a source 276 of argon or other inert gas and, alternately, to a vacuum source (e.g. vacuum pump) 278.

The side wall 256 includes an inner shoulder or flange 284 on which coil supports 286 sit to support the induction coil 268. A mass 219 of low reactivity particulates (like mass 226) extends upwardly between the coil 268 and the melting vessel 254 so as to confine any melt that might leak or otherwise escape from the vessel 254 within the low reactivity particulates.

The melting vessel 254 comprises a cylindrical, tubular ceramic shell 290 supported and fastened (e.g. by potassium silicate ceramic adhesive) atop a ceramic collar 291. The collar 291 is shown including a frangible, refractory closure member 292 held in place by gravity so as to be located proximate the bottom of the melting vessel 254 defined by shell 290, collar 291, and closure member 292. The closure member 292 includes annular notch 292*a* that renders the closure member readily breakable following the casting operation in a manner to be described.

The ceramic shell 290 and collar 291 are also formed by the lost wax process described hereabove. For casting TiAl, shell 290, collar 291 and closure member 292 comprise the materials described hereabove in connection with the embodiment of FIG. 1. After the shell 290, collar 291, and closure member 292 are assembled together to form the melting vessel 254, the vessel 254 is lined with GRAFOIL graphite sheet or graphite cloth material liner 294 also of the type described hereabove.

The open upper end of the melting vessel 254 is partially closed by a closure plate 300 made of fibrous alumina. The plate 300 includes a central opening 302 through which the molten metal component of the intermetallic melt and the mold fill pipe 223 can be introduced to the vessel.

The lower closed end of the melting vessel 254 includes an outer shoulder or flange 310 that sealingly engages a similar shoulder or flange 320 on a lowermost chill mold container 322. The container 322 includes a metal (e.g. copper) chill mold 324 positioned therein below the bottom of the melting vessel 254 such that the collar 291 rests sealingly on the chill mold 324. The particulates mass 219 is disposed about the collar 291 down to the chill mold as shown and confined by a sleeve 323. The container 322 is supported on an elevator 221.

In use in accordance with a countergravity casting embodiment of the invention, the mold 222 is invested in the particulate mass 226 (e.g. zirconia grain) in the container 220 with the fill pipe 223 extending out of the container 220, FIG. 4.

The melting vessel 254 is assembled and positioned on the chill mold 324 disposed in the container 322. The container 322 is raised by the elevator 221 to position the charged vessel 254 in the meltinq chamber 252 within the induction coil 268 as shown in FIG. 4. Particulates 219 are then introduced about the melting vessel through opening 302. The charge C2 of solid unalloyed titanium (first metal of the intermetallic alloy) pieces is placed in the melting vessel 254 and the plate 300 is placed thereon. The charge of titanium can comprise low cost titanium scrap sheet, briquettes, and other suitable shapes as described hereabove. Alloyant particulates may be dispersed in the titanium charge C1 as described above.

To begin the casting cycle, the melting chamber 252 is first evacuated to about 100 microns and then backfilled with argon to slightly above atmospheric pressure (>5 torr) via the port 270. The charge (melting stock) of titanium solid pieces is then preheated, if desired, by induction coil 268 to 350–1500° F. (i.e. below the liquidus temperature of titanium).

Concurrently, a charge (melting stock) of aluminum is melted in a melting vessel (not shown but similar to vessel 110 of FIG. 1) outside the casting apparatus to provide the second metal component of the intermetallic alloy. In particular, a charge of aluminum scrap or other unalloyed (or alloyed) aluminum is air melted in the vessel which includes a clay/graphite refractory lining in the manner described hereabove. The molten aluminum is heated to a superheat of about 80° F. and then poured into the melting vessel 254 through the ports 259*a*, 261*a* and 302. The amount of molten aluminum added to the vessel 254 corresponds to the weight % of aluminum desired in the intermetallic alloy.

With argon gas pressure slightly above atmospheric pressure, the induction coil 268 is energized to a power level to heat the solid titanium charge and the molten aluminum charge to melt and react them in the melting vessel 254. The titanium and aluminum charges react exothermically in the vessel 254 to generate substantial heat that accelerates the melting process to reduce the time needed to obtain an intermetallic melt M ready for casting into the mold 222 and that also replaces electrical power that otherwise would be required from the induction coil 268. A power level of 240 KW has been used to produce a TiAl melt (42 pounds) ready for casting after only 1.25 minutes following energization of the induction coil 268. Generally, a power level in the range of 200 to 240 KW applied for 1.25 to 2.0 minutes can be used to produce TiAl melts in the weight range of 40 to 50 pounds. The power level and time can be varied and controlled to achieve the desired superheat in short times.

The time required to produce a TiAl melt M in the vessel 254 ready for casting in the mold 222 is quite short, not exceeding a power-on time of about 2 minutes typically. As a result, the residence time of the melt in the vessel 254 is short enough that no harmful reaction of the melt and the vessel refractory liner is experienced. This results in a melt that is useful for structural castings.

Figure 5:
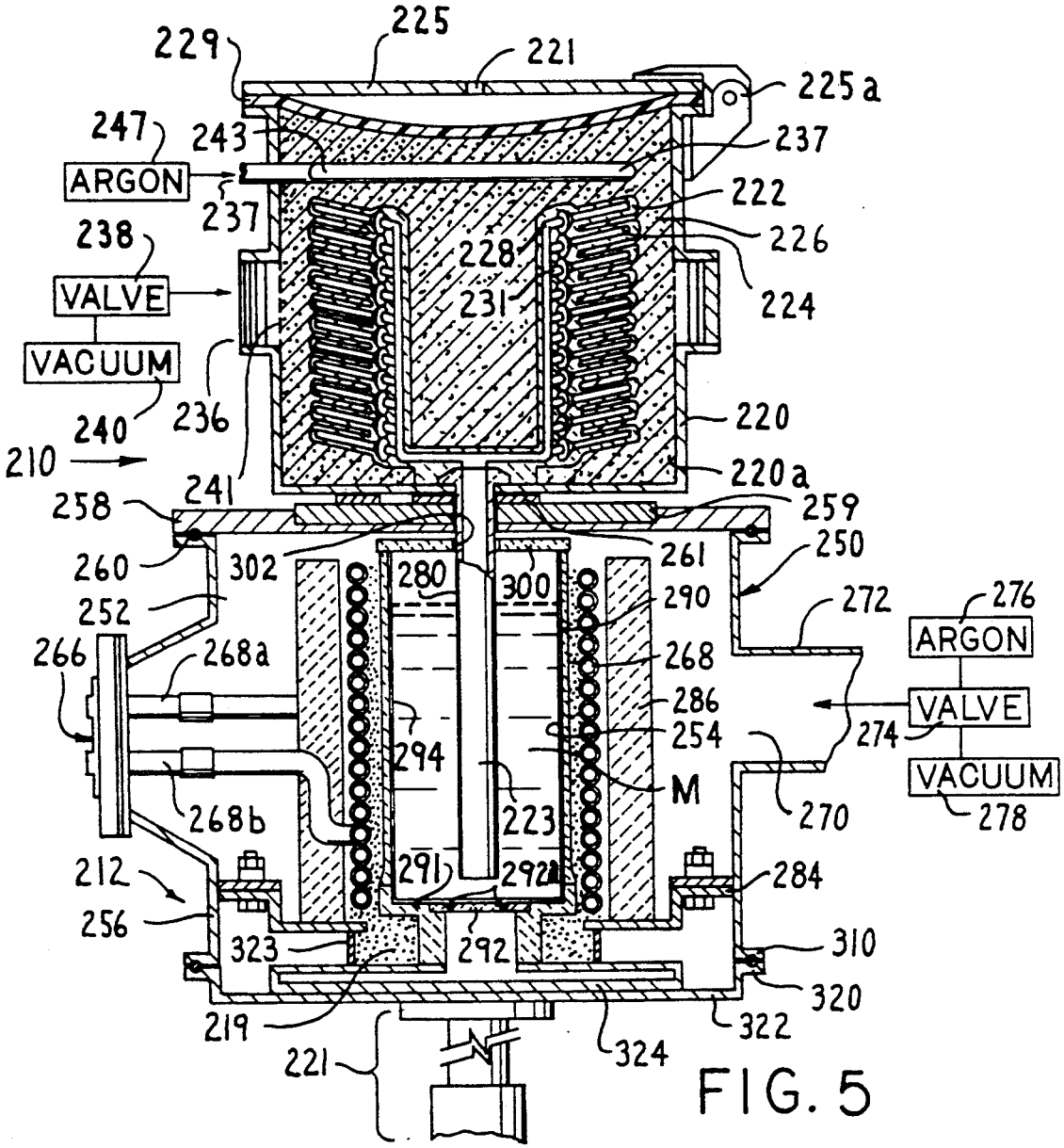
FIG. 5 is similar to FIG. 4 with the fill pipe immersed in the melt.

As soon as the melt reaches the desired casting (superheat) temperature (e.g. after only 1.25 minutes), the container 220 is lowered to insert the fill pipe 223 through the port 259*a* and also port 302 into in the melt M in the vessel 254, FIG. 5. The container 220 is moved by the aforementioned hydraulically actuated arm (not shown). Before or upon immersion of the fill pipe in the melt, a vacuum is drawn in the container via chamber 236. A vacuum is thereby applied to the mold 222 compared to the atmospheric argon gas pressure in the melting chamber 252 so as to establish a negative pressure differential pressure between the mold cavities 224 and the melt in the vessel 254 sufficient to draw the melt upwardly through the fill pipe 223 into the mold 222.

After the mold 222 is filled with the melt and the castings are solidified in mold cavities 224, the container 220 is lowered to cause the fill pipe 223 to strike and break the closure member 292 and liner 294. The container 220 is then raised to withdraw the fill pipe 223 from the melt chamber 252. Some of the melt in the fill pipe drains back into the vessel during this movement. The drained melt and any unused melt remaining in the vessel 254 flow into the chill mold 324 where the melt rapidly solidifies. After the melt in the chill mold cools sufficiently (e.g. to 1100° F.), the melt-filled chill mold 324 and the vessel 254 then can be removed from the melting chamber 252 by lowering the elevator 221.

Use of the chill mold 324 to rapidly solidify the drained/unused melt reduces the time otherwise required to establish a new container 322, chill mold 324, and vessel 254 charged with titanium for further casting of parts. Without the chill mold 234, the drained/unused melt must remain in the vessel 254 and slowly cool to a low enough temperature to permit removal from the melting chamber.

After the new container 322, chill mold 324 and charged vessel 254 are in place in the melting chamber 252 as described before, the aluminum melt can be prepared in the other melting vessel (see vessel 110 of FIG. 1) and the casting cycle described hereabove repeated to cast a new mold 222 in a container 220. As a result, casting cycle time is reduced.

The melt-filled mold 222 (just removed from the melting chamber 252) is left in its container 220 with argon flow through inlet 237 so that the melt can solidify and/or cool to ambient under argon. As mentioned hereabove, the mold material is selected to minimize melt/mold reactions while the melt solidifies in the mold 222. This also aids in production of TiAl castings free of harmful contamination.

The apparatus of FIGS. 4–5 is characterized by a short casting cycle time. For example, in the production of automobile exhaust valves made of TiAl, three molds 222 each containing 270 mold cavities can be countergravity cast per hour using the apparatus of FIG. 3. The charge of TiAl in the vessel would be 54 pounds with 11 pounds drained from the fill pipe 223 when it is withdrawn from the melt after the mold 222 is filled. A total of 4 million exhaust valves can be cast per apparatus (FIG. 4–5) per year as a result. The valves will be cast at low cost relative to other available techniques and will be free of harmful contamination resulting from melt/vessel and melt/mold reactions.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A method of making an intermetallic casting, comprising the steps of:

a) disposing a first charge comprising a solid first metal in a vessel, b) melting a second charge comprising a second metal that reacts exothermically with said first metal, c) introducing the molten charge comprising said second metal to said vessel so as to contact said charge of said first metal, d) heating the charges comprising said first and second metals in contact in said vessel to exothermically react said first and second metals and form a melt for casting whereby the exothermic reaction reduces the time required to achieve said melt and the residence time of said melt in said vessel to reduce contamination of said melt by reaction with said vessel, and e) casting said melt from said vessel into a mold to form said casting upon solidification of said melt.

2. The method of claim 1 further comprising preheating said first charge prior introduction of said molten charge comprising said second metal in said vessel.

3. The method of claim 1 wherein said first charge comprises a plurality of solid pieces of said first metal.

4. The method of claim 3 wherein said pieces comprise scrap pieces comprising said first metal.

5. The method of claim 1 wherein the charges comprising said first and second metals are heated in said vessel by energization of an induction coil about said vessel.

6. The method of claim 1 wherein said melt is gravity cast into said mold disposed below said vessel by breaking a closure member at a bottom of said vessel so as to communicate said mold and said vessel.

7. The method of claim 1 wherein said melt is countergravity cast into said mold disposed above said vessel.

8. A method of making a metal aluminide casting, comprising the steps of:

a) disposing a charge comprising a solid metal in a vessel, b) melting another charge comprising aluminum in another vessel, c) introducing the molten charge comprising aluminum to said vessel so as to contact said charge of said metal, d) heating the charges comprising said aluminum and said metal in said vessel to exothermically react them and form an intermetallic melt for casting whereby the exothermic reaction reduces the time required to achieve said melt and the residence time of said melt in said vessel to reduce contamination of said melt by reaction with said vessel, and e) casting said melt from said vessel to a mold to form said casting upon solidification of said melt.

9. The method of claim 8 further comprising preheating said charge prior introduction of said molten aluminum in said vessel.

10. The method of claim 8 wherein said charge comprises a metal selected from one of titanium, nickel and iron.

11. The method of claim 8 wherein said charge comprises solid scrap pieces of said metal.

12. The method of claim 8 wherein the charges comprising said aluminum and said metal are heated in said vessel by energization of an induction coil about said vessel.

13. The method of claim 8 wherein said melt is gravity cast into said mold disposed below said vessel by breaking a closure member at a bottom of said vessel so as to communicate said mold and said vessel.

14. The method of claim 8 wherein said melt is countergravity cast into said mold disposed above said vessel.

15. A method of making a titanium aluminide casting, comprising the steps of:

a) disposing a charge comprising solid titanium in a vessel, b) preheating said charge in a vacuum, inert gas or other substantially non-reactive atmosphere to an elevated temperature below the liquidus temperature of titanium, c) melting another charge comprising aluminum in another vessel, d) introducing the molten charge comprising aluminum to said vessel so as to contact said charge of said titanium, e) heating the charges comprising aluminum and titanium in said vessel to exothermically react them and form an intermetallic melt for casting whereby the exothermic reaction reduces the time required to achieve said melt and the residence time of said melt in said vessel to reduce contamination of said melt by reaction with said vessel, and f) casting in a vacuum, inert or substantially non-reactive atmosphere said melt from said vessel to a mold to form said casting upon solidification of said melt.

16. The method of claim 15 wherein said melt is gravity cast into said mold disposed below said vessel by breaking a closure member at a bottom of said vessel so as to communicate said mold and said vessel.

17. The method of claim 15 wherein said melt is countergravity cast into said mold disposed above said vessel.

18. A method of making an intermetallic casting, comprising the steps of:

a) disposing first and second metallic components comprising the intermetallic material in a vessel having a breakable member disposed to communicate said vessel to a mold when said breakable member is broken, b) heating said metallic components in said vessel to react them and form a melt heated to a casting temperature, and c) breaking said breakable member with a mechanical means when said melt is at said casting temperature to communicate said vessel and said mold for casting said melt into said mold.

19. The method of claim 18 wherein said breakable member is broken by striking it with a breaking member.

20. The method of claim 19 wherein said breaking member is disposed in a position where one end is disposed inside said vessel evacuated to subambient pressure and another end is disposed outside said vessel at ambient pressure, and means is provided for holding said rod proximate said another end against movement relative to said vessel.

21. The method of claim 2 wherein said another end is released when said melt is at said casting temperature so that ambient pressure on said another end moves said breaking member toward said vessel to cause said one end to stroke and break said breakable member.

* * * * *

UNITED STATES PATENT AND TRADEMARK OFFICE

CERTIFICATE OF CORRECTION

PATENT NO. : 5,299,619

DATED : April 5, 1994

INVENTOR(S) : George D. CHANDLEY, et al

It is certified that error appears in the above-identified patent and that said Letters Patent is hereby corrected as shown below:

Column 14, line 48; replace "Claim 2" with ---Claim 20---.

Signed and Sealed this

Twenty-sixth Day of July, 1994

*Attest:*

*Attesting Officer*

BRUCE LEHMAN

*Commissioner of Patents and Trademarks*